US009714817B1

(12) United States Patent
Jorgensen

(10) Patent No.: US 9,714,817 B1
(45) Date of Patent: Jul. 25, 2017

(54) CENTRAL INITIATING CHARGE

(71) Applicant: The United States of America, as represented by the Secretary of the Navy, Washington, DC (US)

(72) Inventor: Matthew C. Jorgensen, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 196 days.

(21) Appl. No.: 14/640,159

(22) Filed: Mar. 6, 2015

(51) Int. Cl.
*F42B 1/00* (2006.01)
*F42B 3/08* (2006.01)
*F42B 3/10* (2006.01)

(52) U.S. Cl.
CPC . *F42B 3/08* (2013.01); *F42B 3/10* (2013.01)

(58) Field of Classification Search
CPC ... C06C 5/06; F42D 1/043; F42B 1/02; F42B 3/103
USPC ..... 102/275.3, 275.4, 275.8, 305, 475
See application file for complete search history.

(56) References Cited

U.S. PATENT DOCUMENTS 2,707,438 A * 5/1955 Mann ..... C06C 5/06 102/275.3
2,736,263 A * 2/1956 Lewis ..... C06C 5/06 102/275.3
2,796,834 A * 6/1957 McCaffrey ..... C06C 5/06 102/275.3
3,707,917 A 1/1973 Zernow et al.
4,112,845 A * 9/1978 Savitt ..... F42D 1/04 102/275.3
4,316,412 A * 2/1982 Dinegar ..... F42B 3/103 102/202.5
5,271,332 A 12/1993 Guirguis
5,493,972 A * 2/1996 Winterberg ..... B01J 3/08 102/305
6,467,416 B1 * 10/2002 Daniels ..... F42B 12/10 102/476
6,739,265 B1 * 5/2004 Badger ..... F42B 1/00 102/275.11
6,766,744 B1 * 7/2004 Song ..... F42B 1/02 102/311
8,037,828 B1 * 10/2011 Jakaboski ..... F42B 1/02 102/305
8,267,012 B2 * 9/2012 Peeters ..... E21B 43/1185 102/275.4
8,371,224 B1 * 2/2013 Boswell ..... F42C 19/0807 102/217
9,347,754 B1 * 5/2016 Cundiff ..... F42C 19/08

OTHER PUBLICATIONS

G. Bjarnholt & U. Smedberg, "On Detonation Driven Air Shocks in the Air Gap Between a charge and its Confinement," Eighth Symposium (International) on Detonation, vol. 8, 1985, pp. 1069-1079.

(Continued)

*Primary Examiner* — Michael David
(74) *Attorney, Agent, or Firm* — James M. Saunders

(57) ABSTRACT

A central initiating charge according to embodiments of the invention includes a pellet. The pellet has a proximal end and a distal end. A central longitudinal axis spans from the proximal end to the distal end. A void spans longitudinally in said pellet. The void spans parallel to the central longitudinal axis.

15 Claims, 3 Drawing Sheets

(56) References Cited

OTHER PUBLICATIONS

C.H. Johansson, H.L. Selberg, A. Persson, T. Sjoelin, "Channel Effect in Detonation in Tubes with an Open Space Between the Charge and the Tube Wall," XXX1 International Congress of Industrial Chemistry, Sep. 1958, pp. 258-261, Liege, Belgium.

* cited by examiner

CENTRAL INITIATING CHARGE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

Embodiments of the invention generally relate to charges.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

Embodiments of the invention are related to charges and employ a single explosive pellet. In some embodiments, an explosive mass, charge, or element may be used. Embodiments more accurately center a detonation wave in reference to the nominal desired initiation point on an explosive fill being initiated by the embodiment. This is mainly due to using an explosive phenomenon called the channeling effect. The channeling effect artificially increases the detonation velocity in a local region following a thin crack or hole. The channeling effect is usually viewed as a detrimental phenomenon which can misshape a detonation wave resulting in undesirable effects in the initiation of explosive charges.

Embodiments more accurately center a detonation wave in reference to a nominal initiation point on an explosive fill by reducing tolerance stack up. The embodiments eliminate the need for multiple explosive pellets and housings—each containing their own tolerance stack up. Additionally, the mode of central initiation is not formed by constricting the detonation wave which has explosive critical diameter limitations.

Although embodiments of the invention are described in considerable detail, including references to certain versions thereof, other versions are possible. Examples of other versions include performing alternate combinations and sequencing of the materials. Therefore, the spirit and scope of the appended claims should not be limited to the description of versions included herein.

Figure 1A:
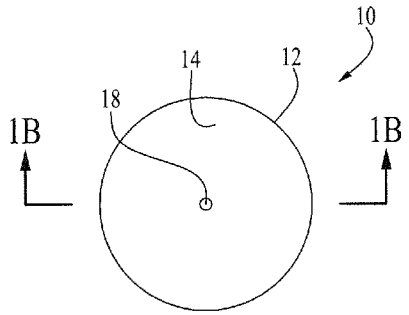
FIG. 1A is a top view of a central initiating charge, showing cut plane 1B-1B (section 1B-1B is depicted in FIG. 1B), according to some embodiments of the invention.
Figure 1B:
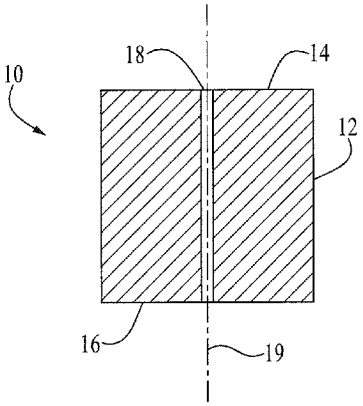
FIG. 1B is a section view perpendicular to cut plane 1B-1B of FIG. 1A, according to some embodiments of the invention.
Figure 1C:
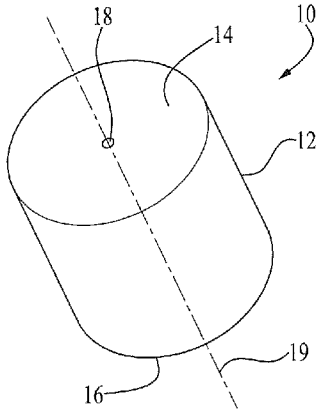
FIG. 1C is a projected view of a central initiating charge, according to some embodiments of the invention.

In the accompanying drawings, like reference numbers indicate like elements. Reference character 10 depicts an apparatus of embodiments of the invention. Referring simultaneously to FIGS. 1A through 1C, embodiments of the invention generally relate to a central initiating charge 10. The central initiating charge 10 may be used to initiate an explosive fill (reference character 24 in FIGS. 2 & 3) such as, for example, in a firing train. The central initiating charge 10 may be used as the last pellet in a firing train to initiate the explosive fill 24 (FIGS. 2 & 3), which is may sometimes be referred to as an explosive main fill.

However, in some embodiments, reference character 24 (FIGS. 2 & 3) may be used to represent an insensitive main fill formulation or standard main fill formulation. In those instances, the central initiating charge 10 may be used to initiate the insensitive main fill formulation/standard main fill formulation 24 under physical conditions that may reduce its sensitivity to impact (such as in cold temperature and pre-shocked environments) more reliably because the channeling effect increases the pressure input to the explosive fill (sometimes referred to as an acceptor charge) near the void (discussed below and illustrated as reference character 18).

Figure 2:
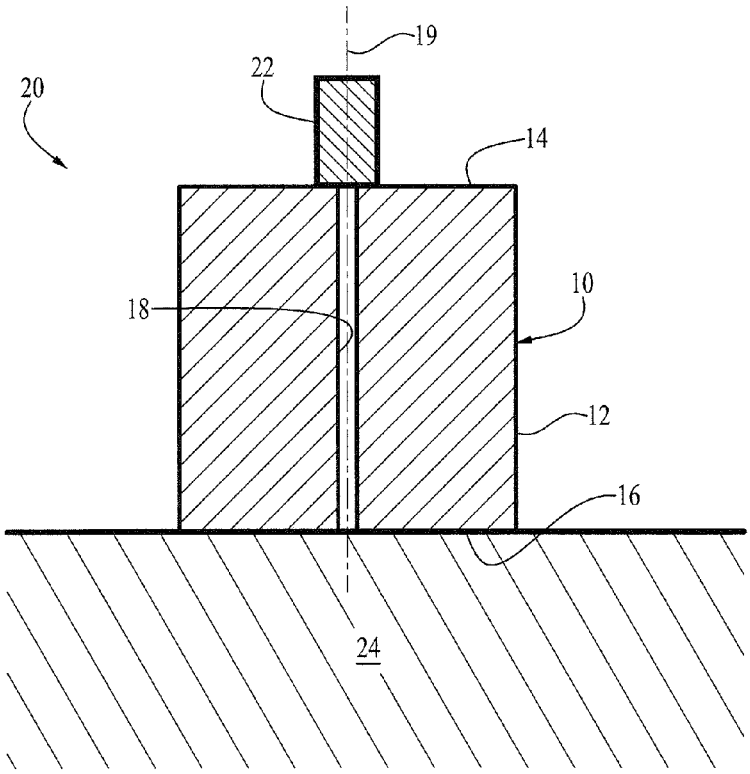
FIG. 2 is a section view of the apparatus of FIG. 1C and depicts how the apparatus relates to the environment including an initiator centered on the apparatus' central longitudinal axis, according to some embodiments of the invention.
Figure 3:
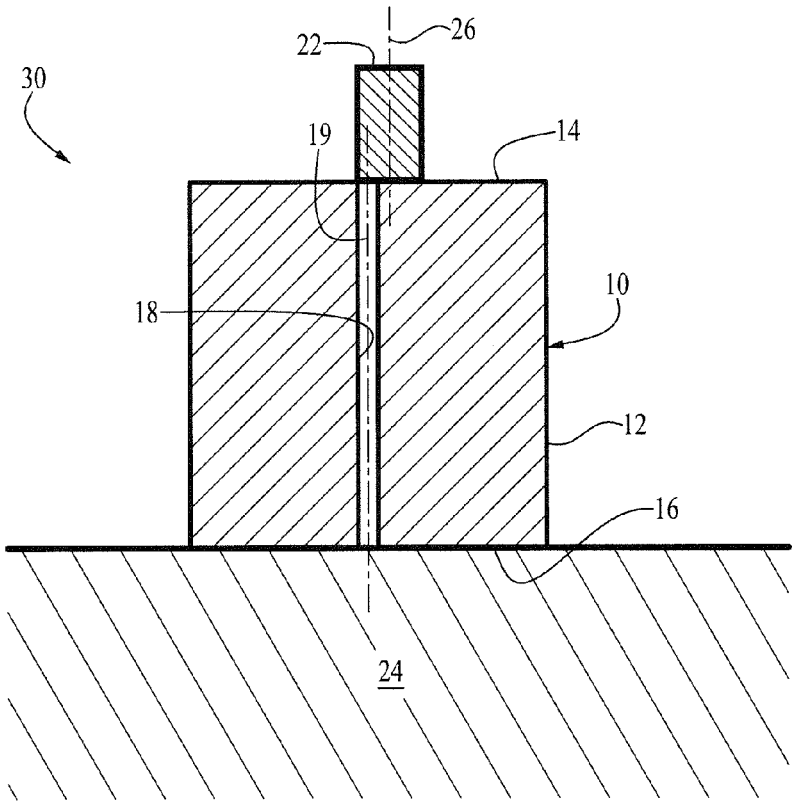
FIG. 3 is a section view of the apparatus of FIG. 1C and depicts how the apparatus relates to the environment including an initiator off-set of the apparatus' central longitudinal axis, according to some embodiments of the invention.

The word "central" describing embodiments of the invention ("central initiating charge") means that the initiation of the central initiating charge 10 is directed to the center of the explosive fill 24 nominal initiation point, based on application-specific conditions, and coinciding with the central longitudinal axis 19 as shown in FIGS. 2 & 3, and described below.

The central initiating charge 10 includes a pellet 12. The pellet 12 is an explosive element and may sometimes be referred to as an explosive mass, an explosive charge, or a booster pellet, and has a proximal end 14 and a distal end 16. The proximal and distal ends 14 & 16 may also be referred to as the first and second ends or as the input and output ends, respectively. Both the proximal 14 and distal ends 16 have substantially-flat surfaces. Since a single pellet 12 is used, tolerance stackup is removed because adjacent pellets are not used. Additionally, the use of a single pellet 12 eliminates the need for an individual pellet housing, which also reduces tolerance stackup. Since the pellet 12 is a booster pellet, a person having ordinary skill in the art will recognize that a housing would be used (although it is not depicted in the accompanying figures for ease of viewing) to hold the pellet, initiator 22 (FIGS. 2 & 3), and other components for initiation.

A void 18 is centered in the pellet 12 and spans longitudinally from the proximal end 14 to the distal end 16. As shown in FIGS. 1A through 1C, the void is centered about a central longitudinal axis 19. The central longitudinal axis 19 is common to both the pellet 12 and the void 18.

As depicted in FIGS. 1A through 3, the void 18 is shown as a single passage, circular in cross-section, and spanning the entire length longitudinally from the proximal end 14 to the distal end 16 of the pellet 12. However, in some embodiments, more than one void 18 may be used. Greater than one void 18 is useful when employing embodiments of the invention where the goal is to have multiple initiation points on the explosive fill 24. In those instances, it may be advantageous to angle the void 18 in relation to the central longitudinal axis 19 of the pellet 12 to increase the reliability and effect of the channeling effect by having the resulting detonation wave from the initiator 22 travel orthogonally to the axis of the void.

Likewise, in some embodiments, the void 18 may not span the entire length of the pellet 12. The void 18 may, instead, for example, perforate through the distal end 16 of the pellet 12 and span partially longitudinally towards the proximal end 14, but not actually perforating the proximal end. The central initiating charge 10 can employ any type of explosive because embodiments of the invention are not restricted by critical diameter constraints. As such, a person having ordinary skill in the art will recognize that the type of explosive used for the pellet 12 determines the dimensions (length and width/diameter) of the pellet and the void 18.

Additionally, the void 18 is depicted as being centered along the central longitudinal axis 19, however, in some embodiments, the void may be located off-center from the central longitudinal axis. When the void 18 is located off-center from the central longitudinal axis 19, the void is common to its own longitudinal axis (not shown for ease of viewing) which is parallel to the central longitudinal axis.

The void 18 may be referred to as a hole, aperture, passage, passageway, and the like without detracting from the merits or generalities of embodiments of the invention. For embodiments using small diameter pellets 12 (defined as pellets that can fit within a cube with side lengths of one inch), the void 18 has a functional diameter range of about 0.030 to about 0.060 inches. The void 18 is depicted as a circular hole through the pellet 12, although other geometric shapes are also disclosed. Additionally, the void 18 may also be rectangular (including square), trapezoidal, triangular, and threaded, such as helical, without detracting from the merits or embodiments of the invention.

The pellet 12 is formed using die sets or molds that can maintain application-specific geometric tolerances. A person having ordinary skill in the art will recognize that the geometric tolerances are defined by the size of the pellet 12 and, specifically, the diameter of the pellet, and even more specifically, as a percentage of the diameter of the pellet. The pellet 12 is pressed into cylindrical shape. The void 18 is formed either by boring into the pellet or as a preset void space, such as, for example, by using a removable pin in the die set. The void 18 is substantially smooth.

The pellet 12 is configured to be initiated. Upon initiation, a detonation wave is driven longitudinally through the void 18 along the central longitudinal axis 19, extending from the proximal end 14 to the distal end 16. The detonation wave is not shown in the figures for ease of viewing and due to a person having ordinary skill in the art being cognizant of detonation waves.

FIG. 2 illustrates how the pellet 12 relates to one environment, shown as reference character 20. An initiator 22 is shown centered on the proximal end 14 of the pellet 12 and centered above the void 18. The initiator 22 is an initiated explosive and, in FIG. 2, is shown centered about the central longitudinal axis 19 of the pellet 12. The initiator 22 may be mechanically, thermally, electrically, chemically, or shock initiated.

The initiator 22 has its own initiator central longitudinal axis that is distinct from the central longitudinal axis 19 of the pellet 12. However, in the embodiment illustrated in FIG. 2, both the initiator central longitudinal axis and the central longitudinal axis 19 of the pellet 12 are aligned with each other and lie along the same axis and, as such, only reference character 19 is shown. However, the initiator central longitudinal axis is shown and described with reference to FIG. 3 below.

As depicted in FIG. 2, the initiator 22 is positioned in intimate adjacent contact with the proximal end 14 of the pellet 12. The distal end 16 of the pellet 12 is positioned in intimate adjacent contact with an explosive fill 24. The explosive fill 24 is a solid mass.

FIG. 3 illustrates another variation of how the pellet 12 relates to the environment, shown as reference character 30. The initiator 22 is shown to be positioned off-center of both the proximal end 14 and void 18 of the pellet 12. Unlike FIG. 2, the initiator 22 in FIG. 3 has an initiator central longitudinal axis 26 that is distinct from the central longitudinal axis 19 of the pellet 12. Thus, in FIG. 3, the initiator central longitudinal axis 26 is offset from the central longitudinal axis 19 of the pellet 12, illustrated as the central longitudinal axis and initiator central longitudinal axis lying in different axes that are not aligned with each other.

FIGS. 2 & 3 further illustrate an example firing train according to embodiments of the invention. In both FIGS. 2 and 3, the central initiating charge 10 is used in a firing train and is placed in line with the initiator 22 (an explosive charge). The initiator 22 is configured to initiate at a desired point and acts on the pellet 12. The pellet 12 is positioned with its void 18 placed in line with the desired initiation point of the explosive fill 24. Upon a centered or non-centered initiation of the central initiating charge 10, the resulting detonation wave is driven at higher velocity in the void 18 by the channeling effect (linearly in the void from the proximal end 14 to the distal end 16). The channeling effect is normally viewed as a disadvantage. However, embodiments of the invention make advantageous use of it. The detonation wave compresses air in the void 18 as it travels through the pellet 12, resulting in a local region of higher density explosive around the void which increases the detonation velocity in reference to the uncompressed explosive in the pellet. Due to the increased detonation velocity around the void 18, the traveling detonation wave is driven down the location of the void at a faster rate than the surrounding explosive. Therefore, the detonation wave is shaped to centralize itself along the central longitudinal axis 19 with an off-axis initiation of the pellet 12 (shown in FIG. 3), resulting in the explosive fill 24 being initiated at a desired location.

A person having ordinary skill in the art will recognize that the initiator 22 may, in some instances, not have an initiator central longitudinal axis 26 due to the initiator shape being substantially-flat in profile. Similarly, a person having ordinary skill in the art will recognize that some initiators may be used to initiate the central initiating charge 10 without being in intimate adjacent contact with the pellet 12. An example includes a flyer plate initiator.

A person having ordinary skill in the art will recognize that the pellet 12, initiator 22, and other firing train elements are assembled and located within an inert material housing. The inert material housing is not depicted in the associated figures for ease of viewing. Some example inert material housings include, but are not limited to, plastics, wood, and cardboard. However, the components may also be attached by adhesive bonding. Other suitable attachment methods known in the art are envisioned based on application-specific conditions without detracting from the merits or generalities of embodiments of the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A firing train having a central initiating charge configured for centering a detonation wave on an explosive fill by advantageously using the channeling effect, comprising:

a cylindrically-shaped explosive pellet having a proximal end, a distal end, and a central longitudinal axis spanning from said proximal end to said distal end;

wherein said proximal end is in intimate adjacent contact with an initiator;

wherein said distal end is in intimate adjacent contact with an explosive fill; and a void centered about said central longitudinal axis and spanning longitudinally from said proximal end to said distal end, said void having a constant width measured perpendicularly to said central longitudinal axis, wherein said void perforates said proximal end and said distal end;

wherein when said cylindrically-shaped explosive pellet is initiated by said initiator, said initiation centering a detonation wave and increasing the detonation velocity of said detonation wave in said void by driving a detonation wave longitudinally through said void along said central longitudinal axis from said proximal end to said distal end.

2. The central initiating charge according to claim 1, wherein said proximal and said distal ends are substantially-flat surfaces.

3. The central initiating charge according to claim 1, wherein said detonation wave compresses air in said void, said compression resulting in a local region of higher density explosive around said void, wherein said detonation wave is shaped to centralize itself along said central longitudinal axis.

4. The central initiating charge according to claim 1, wherein said detonation wave is driven longitudinally from said proximal end to said distal end in said void to increase detonation velocity.

5. A firing train, comprising:

a cylindrically-shaped explosive pellet having a proximal end, a distal end, and a central longitudinal axis spanning from said proximal end to said distal end; and a void centered about said central longitudinal axis and spanning longitudinally from said proximal end to said distal end, said void having a constant width measured perpendicularly to said central longitudinal axis, wherein said void perforates said proximal end and said distal end;

an initiator having an initiator central longitudinal axis, said initiator positioned in intimate adjacent contact with said proximal end of said cylindrically-shaped explosive pellet;

wherein said distal end of said cylindrically-shaped explosive pellet is positioned in intimate adjacent contact with an explosive fill;

wherein said initiator is configured to initiate said cylindrically-shaped explosive pellet, said initiation driving a detonation wave longitudinally through said void along said central longitudinal axis from said proximal end to said distal end.

6. The firing train according to claim 5, wherein said proximal and said distal ends are substantially-flat surfaces.

7. The firing train according to claim 5, wherein said detonation wave compresses air in said void, said compression resulting in a local region of higher density explosive around said void, wherein said detonation wave is shaped to centralize itself along said central longitudinal axis and drive into said explosive fill.

8. The firing train according to claim 5, wherein said detonation wave is driven longitudinally from said proximal end to said distal end in said void to increase detonation velocity.

9. A method of initiating an explosive fill, comprising:

providing a cylindrically-shaped explosive pellet having a proximal end, a distal end, and a central longitudinal axis spanning from said proximal end to said distal end;

said explosive pellet having a void centered about said central longitudinal axis and spanning longitudinally from said proximal end to said distal end, said void having a constant width measured perpendicularly to said central longitudinal axis, wherein said void perforates said proximal end and said distal end;

positioning an initiator in intimate adjacent contact with said proximal end of said cylindrically-shaped explosive pellet, said initiator having an initiator central longitudinal axis; and positioning said distal end of said cylindrically-shaped explosive pellet in intimate adjacent contact with an explosive fill; and initiating said initiator, wherein said initiator initiation initiates said cylindrically-shaped explosive pellet, wherein said cylindrically-shaped explosive pellet initiation drives a detonation wave longitudinally through said void along said central longitudinal axis from said proximal end to said distal end, wherein said detonation wave initiation wave initiates said explosive fill.

10. The method according to claim 9, wherein said proximal and said distal ends are substantially-flat surfaces.

11. The method according to claim 9, wherein said initiator central longitudinal axis is aligned with said central longitudinal axis of said cylindrically-shaped explosive pellet.

12. The method according to claim 9, wherein said initiator central longitudinal axis is off-center of said central longitudinal axis of said pellet.

13. The method according to claim 9, wherein said driving of said detonation wave task, further comprising compressing air in said void, said compression resulting in a local region of higher density explosive around said void.

14. The method according to claim 9, wherein said initiating of said driving of said detonation wave longitudinally from said proximal end to said distal end in said void increases detonation velocity of said detonation wave.

15. The method according to claim 14, further comprising shaping said detonation wave, said shaping configured to centralize said detonation wave along said central longitudinal axis and drive said shaped detonation wave into said explosive fill.

* * * * *